United States Patent [19]

Mauer et al.

[11] Patent Number: 4,628,722

[45] Date of Patent: Dec. 16, 1986

[54] SETTING TOOL FOR RIVET WITH PULL-HEADED MANDREL

[75] Inventors: Dieter Mauer, Lollar; Peter Potzas, Buseck, both of Fed. Rep. of Germany

[73] Assignee: USM Corporation, Farmington, Conn.

[21] Appl. No.: 830,150

[22] Filed: Feb. 14, 1986

[51] Int. Cl.[4] ..... B21D 31/00

[52] U.S. Cl. ..... 72/391; 72/453.17; 227/112

[58] Field of Search ..... 72/391, 453.17, 453.19, 72/114; 29/243.55; 227/107, 112, 139

[56] References Cited

U.S. PATENT DOCUMENTS

| | | | |
|---|---|---|---|
| 3,580,457 | 5/1971 | Henshaw | 72/391 |
| 3,733,882 | 5/1973 | Klein | 72/391 |
| 3,886,783 | 6/1975 | Hirsch | 72/391 |
| 4,027,520 | 6/1977 | Klein | 72/391 |
| 4,205,547 | 6/1980 | Yamasaka | 72/391 |

*Primary Examiner*—Lowell A. Larson
*Assistant Examiner*—David B. Jones
*Attorney, Agent, or Firm*—Alan N. McCartney

[57] ABSTRACT

A blind-riveting tool for setting pull-type rivet assemblies of the kind which has a pulling head on the mandrel comprises abutment member and mandrel-pulling means each with a collet, the latter inside the former, resiliently urged open to admit a mandrel and arranged to be closed by advance of an actuating sleeve on the collet of the abutment member. The abutment member and mandrel-pulling means as a whole are slidable to and from, under air pressure, both having pistons, one behind the other, in a common cylinder, and are separable to effect a rivet-setting stroke by admission of hydraulic fluid between the pistons. Means is provided for delivering a fresh rivet assembly axially into the collets of the abutment member and mandrel-pulling means when they are open in their retracted positions. The tool provides for the rapid and reliable insertion and setting of automatically fed rivet assemblies of the kind referred to, while being easy for the user to operate.

14 Claims, 9 Drawing Figures

SETTING TOOL FOR RIVET WITH PULL-HEADED MANDREL

BACKGROUND OF THE INVENTION

1. Field of the Invention

This invention is concerned with a blind riveting tool comprising a housing, an abutment member having a rivet-engaging face at its forward end to engage the head of a rivet in a rivet-setting operation, and means reciprocable within the housing to pull the mandrel stem relative to the abutment member in the rivet-setting operation, the abutment member and mandrel-pulling means each comprising a plurality of rivet-assembly-engaging parts disposed about a common axis along which the mandrel will be pulled, which parts can be opened and closed relative to said axis to allow in their open condition the introduction therebetween of a mandrel with a pulling head, and in their closed condition the abutment member to engage the rivet head and the pulling means to engage the mandrel under its pulling head, said parts of the abutment member and pulling means being resiliently urged towards their open condition and arranged to be closed by the advance of a surrounding annular actuating element over said parts of the abutment member.

2. Summary of the Prior Art

A blind riveting tool constructed as just referred to is described in U.S. Pat. No. 2,400,354, for example, the tool being arranged for manual operation and for hand feeding, the annular actuating member being also retracted by hand to allow the riveting assembly engaging parts of the abutment member and mandrel-pulling means to open for introduction of the mandrel of a fresh assembly. Whether the tool be constructed as described in said U.S. Pat. No. 2,400,354 with reference to FIGS. 1-6 (in which the actuating member is said to be restored to its forward position by a spring) or with reference to FIG. 7-13, loading of the tool with a fresh rivet is inconvenient and slow, the operator having only two hands for what is essentially a three-handed operation, to hold the tool, operate the actuating member, and pick-up and insert a fresh rivet.

SUMMARY OF THE INVENTION

It is an object of the present invention to provide a blind-riveting tool for use with blind-rivet assemblies of the kind having a pulling head on the mandrel and which has improved means for receiving and engaging the mandrels of such assemblies.

The foregoing object is achieved in accordance with the invention in that said actuating element is mounted in said housing for reciprocation along said common axis behind a forwardly extending sleeve portion of said housing, the abutment member and mandrel-pulling means being also reciprocable along said axis between a rearward position behind said sleeve portion of the housing where they can be opened and closed and a forward position in which rivet-engaging face of the abutment member is exposed for presentation of a rivet to a workpiece.

Preferably, in a tool in accordance with the invention, the actuating element is arranged, in the operation of a tool, to advance along the abutment member before advance of the abutment member into said forwardly extending sleeve portion of the housing, so that the abutment member is kept closed as it passes through said sleeve portion. Preferably, the forwardly extending sleeve portion of the housing has the same internal diameter as the actuating sleeve, and the actuating sleeve in the operation of the tool advances to a rear end of said sleeve portion, so that the abutment member and mandrel-pulling means are held closed by said sleeve portion when in their forward, rivet-setting, positions.

Preferably, in a tool in accordance with the invention, pneumatic means is provided for advancing and retracting said actuating sleeve over the abutment member and for advancing and retracting the abutment member through said forwardly extending sleeve portion of the housing, advance of the abutment member being arranged to occur in the operation of the tool after advance of the actuating sleeve to close the abutment member. Hydraulic means may be provided for effecting relative axial displacement between the mandrel pulling means and abutment means to set a rivet.

Preferably also, in a tool in accordance with the invention, the mandrel-engaging parts of the mandrel-pulling means are accommodated within and keyed to the rivet-engaging parts of the abutment member so that they open and close with opening and closing of the abutment member and are limited in their axial displacement relative thereto by the keying means.

The forwardly extending sleeve portion of the housing of a tool in accordance with the invention may have a longitudinal slot in its wall through which a blind-rivet assembly can be introduced to insert the mandrel stem between the open parts of the abutment member and mandrel-pulling means when the abutment member is in its retracted position behind said portion of the housing. The rivet-assembly feeding means may be provided on the housing of the tool to receive a blind-rivet assembly from a hose along which it is blown and directing it through said slot in said sleeve portion of the housing and axially into the open abutment member and mandrel-pulling means. Furthermore, said feeding means may comprise an arcuate tubular element mounted to rock about its center of curvature on an axis lying in a direction at right angles to that of the reciprocation of the abutment means and so disposed that in an advanced delivery position said tubular element projects into said housing through said slot and a delivery end of said tubular element is in register with the open abutment means, while the other, inlet, end of the tubular element is in register with a delivery end of said hose, and in a retracted position is withdrawn from the path of the abutment means through said forwardly extending sleeve portion of the housing. Advance and retraction of said tubular element may be effected in the operation of the tool by said actuating sleeve, and the tool may comprise rack and pinion means for advancing and retracting said tubular element, said rack being coupled to said actuating sleeve by a lost motion connection so that movement of the tubular element occurs only towards the end of the forward and rearward strokes of said sleeve.

The abutment member of a tool in accordance with the invention may comprise a sleeve with a piston at its rear end slidable in a fluid-pressure cylinder, and the mandrel-pulling means may also comprise a sleeve projecting forwardly into that of the abutment member and having a piston at its rear end slidable in said cylinder behind that of the abutment member. Fluid passages are provided in the housing to enable pressurized fluid to act on the rear of the piston of the mandrel-pulling means to advance both pistons, and in front of the piston of the abutment member to retract them both. There is also a fluid passage through the wall of the mandrel-pulling means adjacent its piston which thus opens into said cylinder between said pistons and through which fluid under pressure can be introduced to separate said pistons while they are at the front end of said cylinder to effect a rivet-setting stroke of the mandrel-pulling means in the operation of the tool. Such a tool may have means to supply air under pressure to said cylinder in front of the piston of the abutment member and behind the piston the mandrel-pulling means, and means to supply hydraulic fluid to the inside of the sleeve of the mandrel-pulling means for admission to the cylinder between said pistons. A hollow cylindrical rod or sleeve may extend forwardly from an end cap at the rear end of said cylinder, through an annular seal in the piston of the mandrel-pulling means, and terminate in an annular seal bearing on the inner surface of the sleeve of the mandrel-pulling means, hydraulic fluid for admission to said cylinder between said pistons passing through the hollow rod from the rear, through a passage in the wall of the hollow rod just behind its annular seal, and through the annular chamber between said rod and the last-mentioned sleeve to said passage through the wall adjacent the piston of the mandrel-pulling means. In such a case the hollow rod may have a double cylindrical wall, the hydraulic fluid flowing through a space, sealed at each end, between the walls, the inner wall providing a passage for the rearward ejection of broken-off mandrel stems.

There now follows a detailed description, to be read with reference to the accompanying drawings, of a blind riveting tool in accordance with the invention illustrative thereof. It will be realized that this illustrative tool has been selected for description by way of example and not of limitation of the invention.

DESCRIPTION OF THE PREFERRED EMBODIMENT

Figure 1:
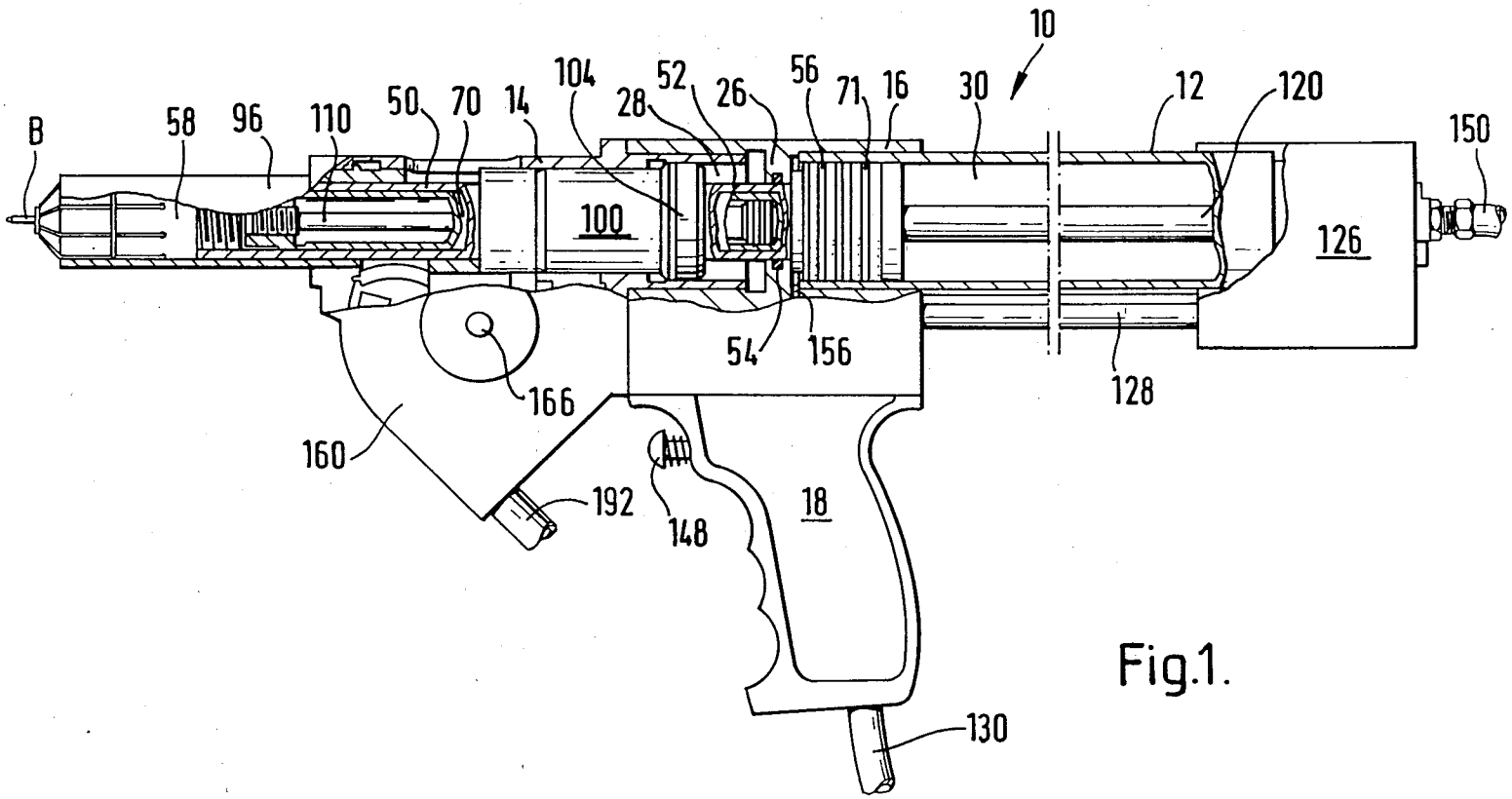
FIG. 1 is a view in side elevation and partly in longitudinal section of the illustrative tool, the tool having been loaded with a blind-rivet assembly and being ready for presentation to a workpiece for a blind-riveting operation.
Figure 4:
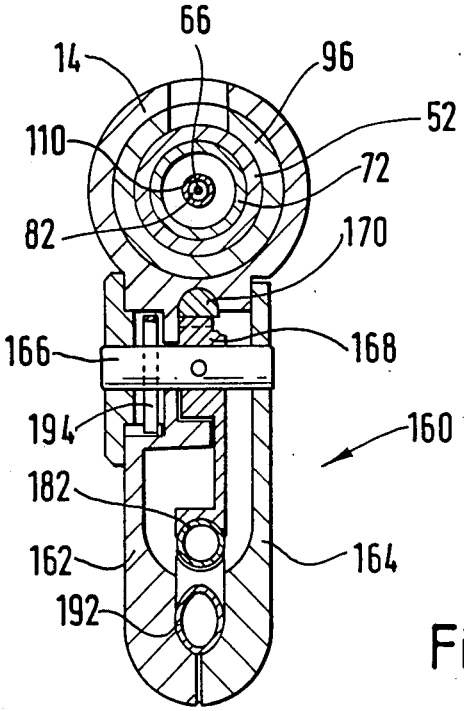
FIG. 4 is a view in transverse section on the line IV—IV of FIG. 5.

Referring to FIG. 1, the illustrative tool comprises a housing 10 with a rearward extension which provides a pneumatic/hydraulic cylinder 12, and a front part which includes a forwardly extending sleeve 14. Depending from a central body 16 of the housing 10 is a pistol grip handle 18 (see also FIG. 4). The central body 16 of the housing 10 has an intermediate annular wall 26 separating internal, forward and rearward bores 28, 30 respectively, the bore 30 extending through the cylinder 12 and being much longer than the bore 28.

Figure 2:
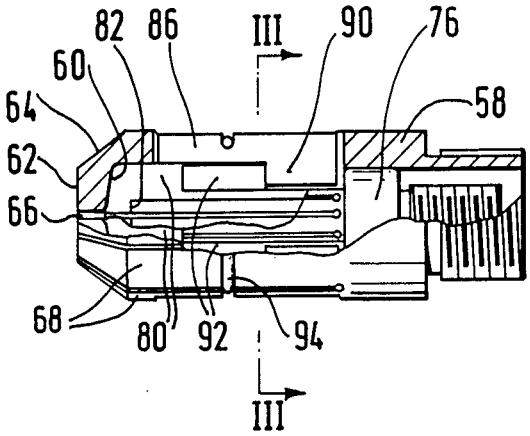
FIG. 2 is fragmentary view partly in radial section of rivet-assembly engaging parts of an abutment member and mandrel-pulling means of the illustrative tool.
Figure 3:
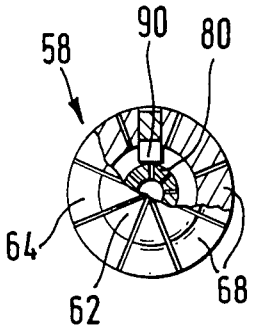
FIG. 3 is a view in transverse section on the line III—III of FIG. 2.
Figure 5:
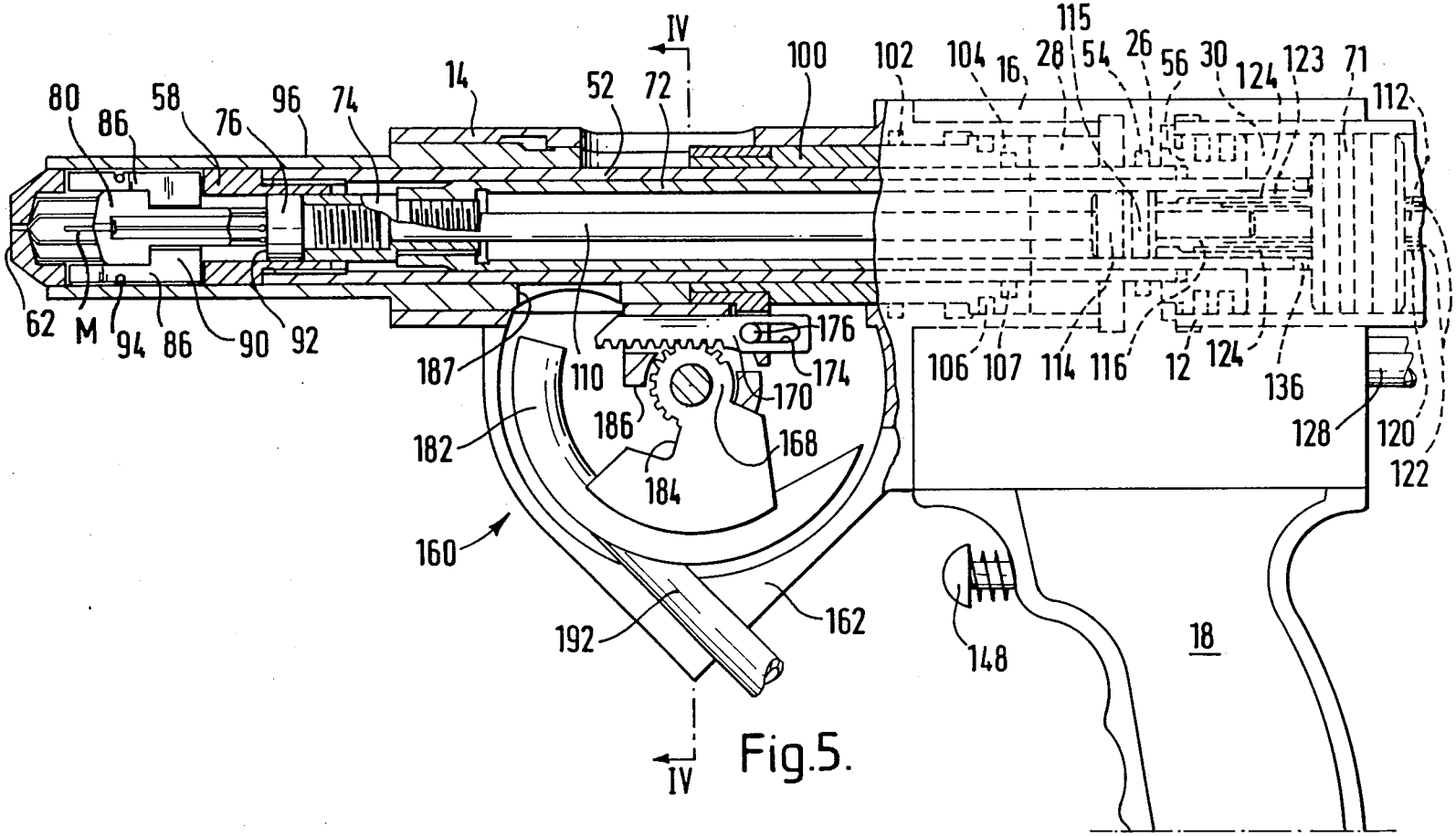
FIGS. 5, 6 and 7 are views similar to FIG. 1 but showing parts of the illustrative tool at successive stages in an operating cycle of the tool, these figures omitting a rear portion of the tool.

Mounted for axial reciprocation in the housing 10 is an abutment member 50 (FIG. 1) of the illustrative tool, said member 50 comprising a hollow cylindrical sleeve 52 slidable through an annular seal 54 (FIG. 5) in the wall 26 and having at its rear end a hollow piston 56 slidable in the bore 30. Screw threaded into the front end of the sleeve 52 is a nosepiece 58 (FIGS. 2 and 3) formed from a hollow steel cylinder having an internal bore which terminates in a conical internal face 60 of obtuse apical angle. Externally, the nosepiece terminates in a flat or hollowed end face 62 for engagement with a rivet head, the face 62 being surrounded by a frusto conical surface 64. Through the end wall thus formed extends a hole 66 of a diameter to accommodate the stem of a mandrel. The nosepiece 58 is divided by eight slots into eight segments 68 extending far enough rearwardly that being splayed outwardly and tempered in their manufacture, they are constantly urged by their own resilience towards an open condition in which their tips, which together provide the end face 62, are wide enough apart to allow the introduction therebetween of a pulling head of a mandrel. When closed by squeezing the segments 68 together, the segments nearly touch each other to provide in effect a continuous annular abutment for the rivet head.

Within the abutment member 50 is a second hollow piston assembly which constitutes mandrel-pulling means 70 of the illustrative tool. The mandrel-pulling means 70 comprises, at its rear end, a hollow piston 71 (FIGS. 1 and 5) slidable in the bore 30 of the cylinder 12 behind the piston 56. The piston 71 is secured to a sleeve 72 slidable through an annular seal in the piston 56. At its forward end, the sleeve 72 threadedly receives an adaptor 74 which in turn is tapped to receive a screw threaded rear end portion of a tubular collet 76 (see also FIG. 2). The collet 76 has resilient fingers 80, similar to the segments 68 and formed in the same way so as to be constantly urged apart and against the inner walls of the segments 68, except that the internal end wall of the collet is flat and it has a frusto-conical outer end wall complimentary to the face 60 of the nosepiece 58. Thus, each finger 80 has a rearwardly facing shoulder 82, normal to the axis of cylinder 12, to engage the underside of the pulling head of a mandrel in a rivet-setting operation.

Because the fingers 80 are constantly urged apart by their own resilience, they open and close in the operation of the tool with the segments 68.

Axial displacement of the pulling means 70 within the abutment member 50 is limited by two stepped stop pieces 86 (FIGS. 2 and 5) accommodated in diametrically opposed radial slots in two of the segments 68 of the abutment member 50. Each stop piece has a projection 90 accommodated in a wide annular groove 92 around the collet 76. The stop pieces 86 are held in their slots by a resilient band 94.

Opening and closing of the segments 68 of the nosepiece 58 of the abutment member 50 and, under their influence, of the fingers 80 of the collet 76 of the mandrel pulling means is effected in the operation of the illustrative tool by moving an actuating element in the form of a sleeve 100 backwards and forwards respectively over the outer surface of the nosepiece. When the actuating sleeve 100 is rearward (as in FIG. 7), the segments 68 are free to open, that is to say spread apart, under their own resilience, to a greater overall diameter than that of the cylinder from which they were formed. The sleeve 100 as an internal diameter which is a sliding fit over the original diameter of the nosepiece. Consequently, as the sleeve 100 moves forward over the nosepiece the segments close together until they nearly touch (in fact, until the slots separating the segments are parallel sided), at the same time also squeezing together the fingers 80 of the collet 76. When open, there is room between the segments 68 and between the fingers 80, for a pulling head of a mandrel to be introduced, and when closed, the segments and fingers closely embrace the mandrel stem.

Screwed into the forwardly extending sleeve portion 14 of the housing 10 is a further forwardly extending sleeve portion 96 of the housing, which has the same internal diameter as the actuating sleeve 100 and consequently serves, when the abutment member 50 advances into it in the operation of the tool, to keep the nosepiece 58 closed.

The actuating sleeve 100 slides in an annular seal 102 in the portion 14 of the housing 10. The sleeve 100 has a flange 104 (which constitutes a piston) at its rear end. The flange 104 carries an external sealing ring 106 which slides in the forward bore 28 of the housing 10, and an internal sealing ring 107 which slides over the outer surface of the sleeve 52 of the abutment member 50.

Figure 8:
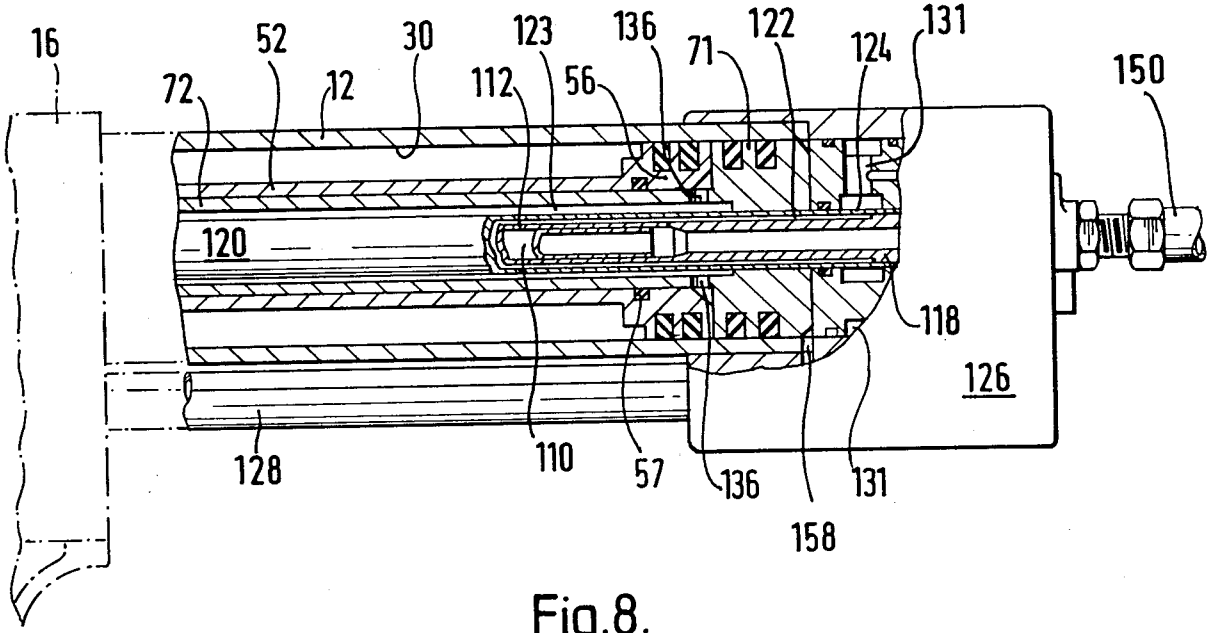
FIG. 8 is a view, largely in section, of said rear portion of the illustrative tool showing parts thereof in positions they occupy in the stages depicted in FIGS. 6 and 7.

Rearwardly projecting from the adaptor 74 to provide a continuous passage therethrough is a tube 110 which passes freely into a hollow sleeve 112. The sleeve 112 has an enlarged head 114 at its front end, which has annular seal 115 bearing on the inside wall of the sleeve 72. The sleeve 112 projects rearwardly through a seal 117 in the piston 71. Most of the length of the sleeve 112, between two bearing portions 116 (just behind the head 114 in FIG. 5) and 118 (FIG. 8), is of reduced diameter, and the bearing portions carry a sleeve 120 so that between these portions within the sleeve 120 there is an annular chamber 122. The sleeve 120 has an outer diameter which is less than the inner diameter of the sleeve 72 so as to provide an annular chamber 123 therebetween. Communication between the chambers 122 and 123 is provided for by ports 124 at each end of the sleeve 120 adjacent the bearing portions 116,118; as will become apparent, the full stroke of the piston 71 takes place between these ports. The sleeve 112 at its rearward end is firmly secured to an end cap 126 mounted on the cylinder 12; the sleeve 112 and head 114 are thus fixed in the housing 10.

The housing 10 of the illustrative tool is provided with passages for oil and air for effecting forward and return strokes of the pistons 56,71 and 104. Thus, in the handle 18 is an inlet 130 through which oil can flow via a tube 128 to and from the end cap 126. Means for connecting the inlet 130 to an oil pressure intensifier is not shown in the drawings, being of conventional construction. From the tube 128 oil is able to flow through passageways 131 in the end cap 126, through the port 124 at the rear end of the sleeve 120 into the annular chamber 122 between the sleeves 112 and 120, and hence through the port 124 at the front into the annular chamber 113 inside the sleeve 72 of the mandrel pulling means 70. Ports 136 open through the sleeve 72 just in front of the piston 71; pressurized oil which thus flows through the ports 136 into the bore 30 of the cylinder 12 is effective to exert pressure on the pistons 56 and 71 urging them to separate. Release of oil pressure allows it to flow back through the system just described.

While the rear of the piston 56 and the front of the piston 71 are always exposed to oil at the pressure supplied at the inlet 130, the front of the piston 56 and the rear of the piston 71 are always exposed to air. Thus, air is introduced and expelled to and from the front and rear of the cylinder 12 through suitable ports 156 (FIG. 5), 158 (FIG. 8) and passageways in the housing 10 not fully described herein, but following normal practice with double-acting cylinders.

Figure 7:
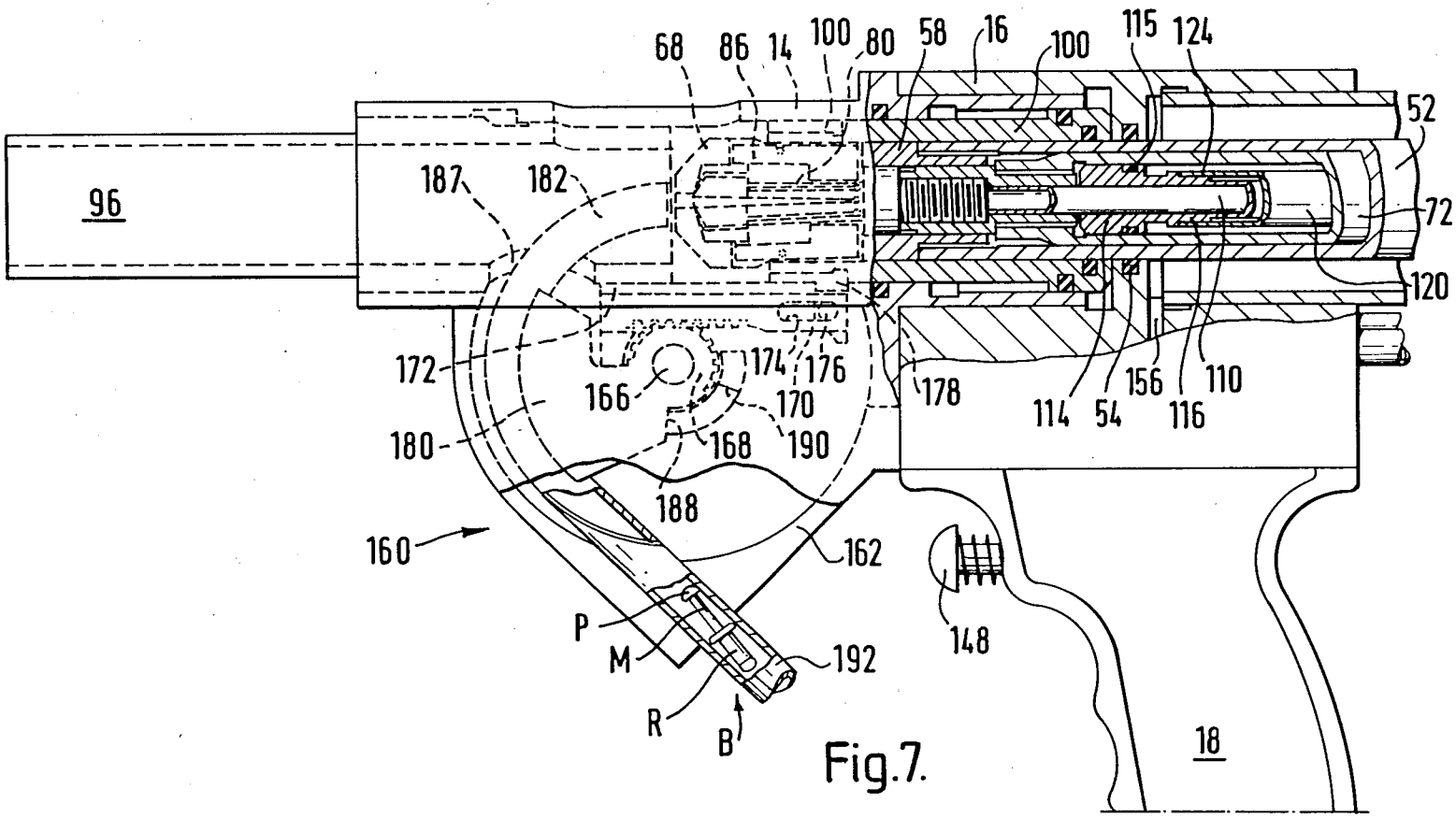

A cycle of operation of the rivet-setting parts of the illustrative tool can best be regarded as starting with the abutment member 50 and mandrel-pulling means 70 in their forward positions as depicted in FIG. 1, with a blind-rivet assembly B comprising a rivet R and a mandrel M loaded in the closed segments 68 and fingers 80; a blind-rivet assembly is shown being delivered to the nosepiece in FIG. 7. The nosepiece 58 projects slightly from the sleeve portion 96 of the housing 10, and is kept closed by said extension. The segments and fingers closely embrace the mandrel 10, the shoulders overlapping a pulling head P of the mandrel, which thus cannot fall out.

Figure 9:
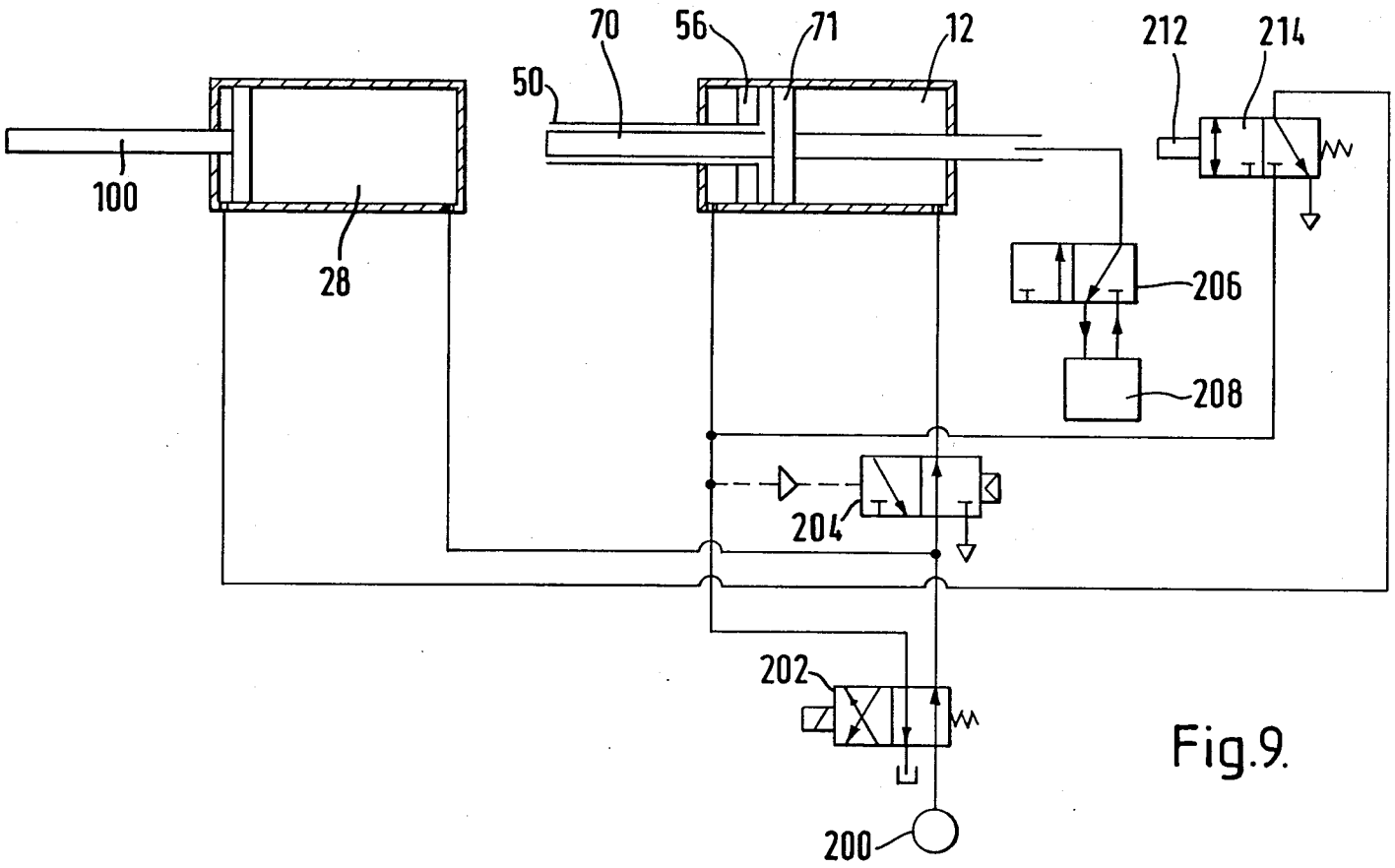
FIG. 9 is a circuit diagram of fluid control means of the tool.

Means for controlling the flow of air and hydraulic fluid to operate parts of the tool in sequence is depicted diagrammatically in FIG. 9. When the tool is at rest as shown in FIG. 1, air from a compressed air supply 200 passes through a two-position valve 202 to the rear end of the cylinder 12 behind the piston 71 and to the bore 28 behind the sleeve 100. The abutment member 50 is thus held in the housing in its foremost position by air under pressure in the cylinder 12 behind the piston 71, which bears on the piston 56, oil pressure at the inlet 130 being atmospheric. Air is also under pressure behind the actuating sleeve 100.

Figure 6:
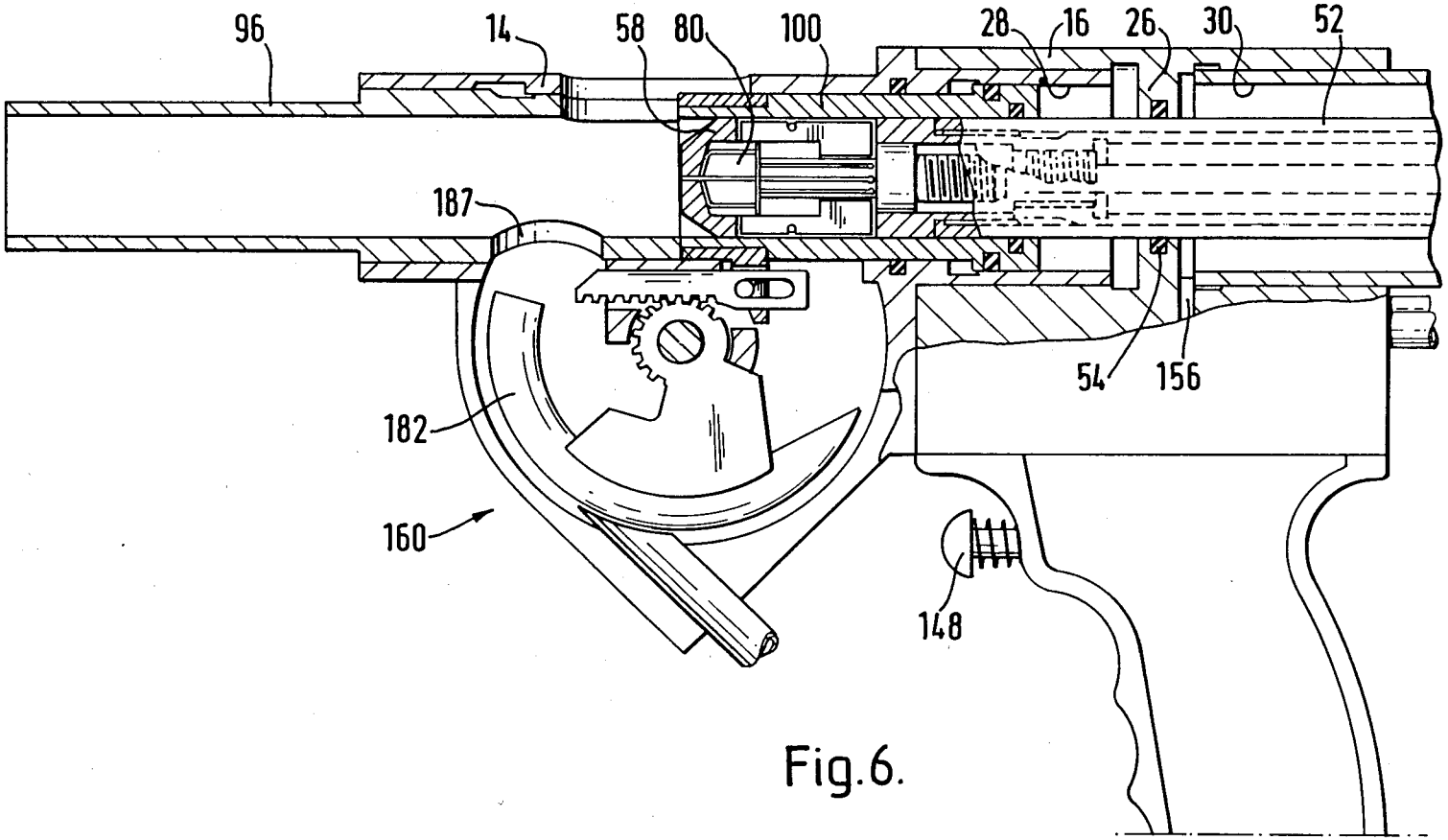

The tool may now be presented to a workpiece (not shown), the rivet R inserted into a hole in the workpiece and the rivet head pushed against the workpiece by the nosepiece 58. On the hand grip 18 is a push-button switch of an electrical control circuit which, on now being depressed by the operator, actuates a solenoid valve 206 in an hydraulic circuit with the result that oil under pressure from a pressure intensifier 208 is admitted to the inlet 130 and thence to the cylinder 12 between the pistons 56 and 71. At the same time, a valve 202 is actuated to open immediately a path to exhaust air from behind the piston 71. The oil forces the pistons 56 and 71 apart, thus pulling the mandrel while pushing on the rivet head, thereby to set the rivet; the mandrel eventually breaks at a neck within the rivet where the mandrel stem is of reduced cross-section and the broken-off portion of the mandrel stem M (which can be seen in FIG. 5), unless it is held by friction between the fingers 80, is ejected rearwardly along the tube 110 and sleeve 112 to a hose 150 leading to a suitable receptacle. Separation of the pistons 57 and 71 is limited by the slots 88 and stop pieces 86. The tool has now assumed the condition shown in FIG. 6. Conveniently, air is arranged to flow gently and continuously rearwardly along the tube, sleeve and hose to facilitate ejection of the mandrel stem, for example by reducing the air pressure in the receptacle so as to create suction through the hose.

Actuation of the valve 202 also opened the bore 28 behind the sleeve 100 to exhaust, and pressurized an air line 210 leading to the front of the cylinder 12. The piston 56 could not at that time retract, however, because the pulling means 70 was held forward by the mandrel. But when the mandrel breaks, the piston 56 moves rearwardly, pushing back the piston 71. After a time delay pre-set in the electrical control circuit, the solenoid valve 206 is de-energized, reversing under spring pressure to allow oil to flow out of the cylinder 12 from between the pistons 56,71. On reaching the rear end of its stroke, the piston 71 engages a spring-pressed plunger 212 of a valve 214 which permits pressurized air from the line 210 to pass into the bore 28 in front of the piston 104 to retract the actuating sleeve 100 and allow the segments 68 of the nosepiece 58 and the fingers 80 for the mandrel-pulling means to open (see FIG. 7) and the broken-off mandrel stem, if not released earlier, to be released and ejected rearwardly of the tool.

As will next be described, in the full operating cycle of the illustrative tool, a fresh blind-rivet assembly is now loaded into the nosepiece 58 and fingers 80, the sleeve 100 advanced, by reversing the air pressure in the bore 28, to close the segments 68 and fingers 80, and the abutment member 50 and mandrel pulling means 70 are advanced by admission of air to the bore 30 behind the piston 71 to restore the rivet-setting parts to the condition shown in FIG. 1. Advance of the sleeve 100 and of the pistons 56 and 71 to their forward positions are effected by reversal of the valve 202 by de-energization of its solenoid, which occurs at a predetermined time after pressing the button 148 as set by a time delay in the electrical control circuit. Advance of the pistons 56,71 is, however, delayed until after the sleeve 100 has advanced by the interposition in the line to the rear of the cylinder 12 of a valve 204 which opens the cylinder 12 behind the piston 71 to pressure only after the pressure in front of the piston 56 has dropped. The tool is thus restored to the condition shown in FIG. 1 whether or not the operator has released the button 148, but a second cycle will not be commenced until he has both released and again pressed the button.

Means of the illustrative tool for loading a fresh rivet assembly into the mandrel-pulling means 70 while the abutment member 80 is retracted will now be described. The assembly-feeding arrangement itself is the subject of our co-pending patent application No. P34 44 025.9.

The sleeve portion 14 of the housing 10 of the illustrative tool has a depending, generally flat sided, extension 160 (FIGS. 4,5 and 7), one side 162 integral with the portion 14, the other serving as a cover 164. The parts 162 and 164 provide support for a rotatable transverse pivot pin 166 to which is secured a pinion 168. The pinion 168 engages a rack 170 longitudinally reciprocable below the sleeve 100 in a bearing 172 provided by the housing portion 14. The rack 170 has teeth along its lower edge in meshed with those of the pinion 168. A longitudinal slot 174 extends along a rear part of the rack, and in the slot 174 rides a pin 176 secured to lug 178 depending from a collar 177 screwed on to the sleeve 100.

Secured to the pinion 168 for to and from arcuate movement therewith is a bracket 180 to which is fixed a curved tube 182 concentric with the pinion 168. When the pinion is rocked clockwise to a limit (depicted in FIG. 7) imposed by the stroke of the sleeve 100, or by engagement of a stop face 184 of the bracket 180 with a stop face 186 of the extension 160, a delivery end of the tube 182 projects through an aperture 187 in the portion 96 of the housing and is in register with the segments 68 of the nosepiece 58, being in alignment with, and close to, them. Also, with the tube 182 in this delivery position, the other, inlet, end of the tube is aligned with a delivery end of a hose 192 which leads from a supply of blind-rivet assemblies. Means for releasing assemblies one at a time with the pulling heads of their mandrels leading and blowing them along the hose 192 (one is shown in FIG. 7) when the tube 182 is in its delivery position so that one is loaded into the mandrel-pulling means is not further described here. The inlet end of the tube 182 and outlet of the hose 192 have complementary curved opposing ends as shown in FIG. 7 to allow the assemblies to pass from the hose to the tube across a minimum gap.

When the pinion 168 is rocked anti-clockwise to its other limit of movement (see FIG. 5) imposed by engagement of stop faces 188 and 190 of the bracket 180 and the extension 160 respectively, or by the stroke of the sleeve 100, the delivery end of the tube 182 swings downwardly out of the path of the abutment member 50, which as already mentioned is next advanced to render the tool ready for the next blind-riveting operation.

To ensure timely rocking of the bracket 180 and tube 182 in the operating cycle of the illustrative tool, a torsion spring 194 (FIG. 4) acts between the housing extension 160 and the pin 166 (to which the pinion 168 is fixed) to urge the bracket 180 clockwise (viewing FIG. 7). The slot and pin connection 174,176 allows lost motion to occur between the sleeve 100 and rack 170 during a first part of the advance of the sleeve 100 so that the segments 58 and fingers 80 close to take control over the newly delivered blind-rivet assembly before the tube 182 moves away from its delivery position.

We claim:

1. A blind-riveting tool comprising a housing, an abutment member having a rivet-engaging face at its forward end to engage the head of a rivet in a rivet-setting operation, and means reciprocable within the housing to pull the mandrel stem relative to the abutment member in the rivet-setting operation, the abutment member and mandrel-pulling means each comprising a plurality of rivet-assembly-engaging parts disposed about a common axis along which the mandrel will be pulled, which parts can be opened and closed relative to said axis to allow in their open condition the introduction therebetween of a mandrel with a pulling head, and in their closed condition the abutment member to engage the rivet head and the pulling means to engage the mandrel under its pulling head, said parts of the abutment member and pulling means being resiliently urged towards their open condition and arranged to be closed by the advance of a surrounding annular actuating element over said parts of the abutment member characterized in that said actuating element is mounted in said housing for reciprocation along said common axis behind a forwardly extending sleeve portion of said housing, the abutment member and mandrel-pulling means being also reciprocable along said axis between a rearward position behind said sleeve portion where they can be opened and closed and a forward position in which the rivet-engaging face of the abutment member is exposed for presentation of a rivet to a workpiece.

2. A tool according to claim 1 wherein the forwardly extending sleeve portion of the housing has the same internal diameter as a sleeve of the actuating element, and the actuating sleeve in the operation of the tool advances to a rear end of said sleeve portion to close said parts of the abutment member and mandrel-pulling means before they advance, said parts of the abutment member and mandrel-pulling means being held closed in their forward position by said sleeve portion of the housing.

3. A tool according to claim 2 wherein pneumatic means is provided for advancing and retracting said actuating sleeve over the abutment member, and for advancing and retracting the abutment member through said forwardly extending sleeve portion of the housing.

4. A tool according to claim 3 wherein hydraulic means is provided for effecting relative axial displacement between the mandrel-pulling means and abutment means to set a rivet.

5. A tool according to claim 1 wherein the mandrel-engaging parts of the mandrel-pulling means are accommodated within and keyed to the rivet-engaging parts of the abutment member so that they open and close with opening and closing of the abutment member and are limited in their axial displacement relative thereto by the keying means.

6. A tool according to claim 1 wherein said forwardly extending sleeve portion of the housing has an aperture in its wall through which a blind-rivet assembly can be introduced to insert the mandrel stem between the open parts of the abutment member and mandrel-pulling means when the abutment member is in its retracted position behind said portion of the housing.

7. A tool-according to claim 6 wherein rivet-assembly feeding means is provided on the housing of the tool for receiving a blind-rivet assembly from a hose along which it is blown and directing it through said aperture in said sleeve portion of the housing and axially into the open abutment member and mandrel-pulling means.

8. A tool according to claim 7 wherein said feeding means comprises an arcuate tubular element mounted to rock about its center of curvature on an axis lying in a direction at right angles to that of the reciprocation of the abutment member and so disposed that in an advanced delivery position said tubular element projects into said housing through said aperture and a delivery end of said tubular element is in register with the open abutment member, while the other, inlet, end of the tubular element is in register with a delivery end of said hose, and in a retracted position is withdrawn from the path of the abutment member.

9. A tool according to claim 8 wherein the advance and retraction of said tubular element is effected in the operation of the tool by said actuating element.

10. A tool according to claim 9 including rack and pinion means for advancing and retracting said tubular element, the rack being coupled to said actuating element by a lost motion connection so that movement of the tubular element occurs only towards the end of the forward and rearward strokes of said actuating element.

11. A tool according to claim 1 wherein the abutment member comprises a sleeve with a piston at its rear end slidable in a fluid-pressure cylinder, and the mandrel-pulling means also comprises a sleeve projecting forwardly into that of the abutment member and having a piston at its rear end slidable in said cylinder behind that of the abutment member, fluid passages being provided in the housing to enable pressurized fluid to act on the rear of the piston of the mandrel-pulling means to advance both pistons and in front of the piston of the abutment member to retract them both, there being also a fluid passage through the sleeve of the mandrel-pulling means adjacent its piston which thus opens into said cylinder between said pistons and through which fluid under pressure can be introduced to separate said pistons while they are at the front end of said cylinder to effect a rivet-setting stroke of the mandrel-pulling means in the operation of the tool.

12. A tool according to claim 11 including means is provided to supply air under pressure to said cylinder in front of the piston of the abutment member and behind the piston the mandrel-pulling means, and means to supply hydraulic fluid to the inside of the sleeve of the mandrel-pulling means for admission to the cylinder between said pistons.

13. A tool according to claim 12 wherein a hollow cylindrical rod of the housing extends forwardly from an end cap at the rear end of said cylinder, through an annular seal in the piston of the mandrel-pulling means, and terminates in an annular seal bearing on the inner surface of the sleeve of the mandrel-pulling means, hydraulic fluid for admission to said cylinder between said pistons passing through the hollow rod from the rear, through a passage in the wall of the hollow rod just behind its annular seal, and through the annular chamber between said rod and the last-mentioned sleeve to said passage through the wall adjacent the piston of the mandrel-pulling means.

14. A tool according to claim 13 wherein the hollow rod has a double cylindrical wall, the hydraulic fluid flowing through a space, sealed at each end, between the walls, the inner wall providing a passage for the rearward ejection of broken-off mandrel stems.

* * * * *